US009921516B2

(12) United States Patent
Miyake et al.

(10) Patent No.: US 9,921,516 B2
(45) Date of Patent: Mar. 20, 2018

(54) IMAGE FORMING APPARATUS AND IMAGE FORMING METHOD

(71) Applicant: CANON KABUSHIKI KAISHA, Tokyo (JP)

(72) Inventors: Toshiyuki Miyake, Abiko (JP); Satoru Yamamoto, Noda (JP); Katsuya Nakama, Nagareyama (JP); Koji Yumoto, Toride (JP); Riki Fukuhara, Kashiwa (JP); Akihiro Kawakita, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/373,184

(22) Filed: Dec. 8, 2016

(65) Prior Publication Data

US 2017/0176884 A1 Jun. 22, 2017

(30) Foreign Application Priority Data

Dec. 18, 2015 (JP) ..... 2015-247355

(51) Int. Cl.
*G03G 15/043* (2006.01)
*G03G 15/00* (2006.01)
*G03G 15/23* (2006.01)

(52) U.S. Cl.
CPC ..... *G03G 15/043* (2013.01); *G03G 15/5062* (2013.01); *G03G 15/55* (2013.01); *G03G 15/234* (2013.01); *G03G 2215/00569* (2013.01); *G03G 2215/0164* (2013.01)

(58) Field of Classification Search
CPC ..... G03G 15/043; G03G 15/0435; G03G 15/0562; G03G 15/55; G03G 15/5054; G03G 15/5058; G03G 2215/0164; G03G 2215/00033; G03G 2215/00037; G03G 2215/00042; G03G 2215/00059; G03G 2215/00067
See application file for complete search history.

(56) References Cited

U.S. PATENT DOCUMENTS

| | | | | |
|---|---|---|---|---|
| 6,980,750 | B2 | 12/2005 | Motoyama et al. | 399/85 |
| 2004/0042807 | A1 | 3/2004 | Nakayama | 399/49 |
| 2011/0091235 | A1* | 4/2011 | Oh | G03G 15/0131 399/74 |
| 2012/0155899 | A1* | 6/2012 | Watanabe | G03G 15/5058 399/49 |
| 2013/0094039 | A1 | 4/2013 | Takemura | 358/1.9 |
| 2013/0243451 | A1* | 9/2013 | Hirota | G03G 15/5062 399/39 |

* cited by examiner

*Primary Examiner* — Carla Therrien
(74) *Attorney, Agent, or Firm* — Fitzpatrick, Cella, Harper & Scinto

(57) ABSTRACT

Provided is an image forming apparatus capable of reducing power consumption by optimizing preliminary operation of a sensor. In the image forming apparatus, when tone characteristics adjustment is instructed (Step S1003: Y), tone characteristics adjustment (Step S1006) is executed after calibration (Step S1004), while when mixed-color correction is instructed (Step S1007: Y), mixed-color correction processing (Step S1009) is executed after calibration (Step S1008). Further, in the case where mixed-color correction is executed after tone characteristics adjustment, the preliminary light emission time in calibration is set shorter than when mixed-color correction is executed without performing gray adjustment first.

9 Claims, 8 Drawing Sheets

IMAGE FORMING APPARATUS AND IMAGE FORMING METHOD

BACKGROUND OF THE INVENTION

Field of the Invention

The present invention relates to an image forming apparatus capable of executing correction processing.

Description of the Related Art

A high level of color reproducibility is demanded for image forming apparatus in recent years. To meet the demand, an image forming apparatus described in US patent application publication No. 2004/0042807 uses a sensor provided on a sheet conveying path to measure a measurement image formed on a sheet. This image forming apparatus corrects tone characteristics based on the result of the measurement of the measurement image by the sensor. Processing of correcting tone characteristics is hereinafter referred to as "tone characteristics adjustment".

An image forming apparatus described in US patent application publication No. 2013/0094039 generates a conversion condition for converting image data based on the result of measurement of a measurement image that has a plurality of colors each in a different layer, in order to adjust the colors of a mixed-color image with high precision. Processing of generating the conversion condition is hereinafter referred to as "mixed-color correction".

In image forming apparatus with this type of sensor installed therein, heat generation from a light emitting unit configured to emit light toward a measurement image causes errors in the measurement value of the sensor. The image forming apparatus therefore raises the temperature of the sensor by emitting light from the light emitting unit of the sensor before the measurement of a measurement image with the sensor. This enables the image forming apparatus to reduce measurement value fluctuations that are caused by changes in the temperature of the sensor itself.

However, there are cases where the image forming apparatus of US patent application publication No. 2013/0094039 executes tone characteristics adjustment and mixed-color correction in succession. The image forming apparatus of US patent application publication No. 2013/0094039 in this case needs to execute optimum preliminary operation of the sensor before correction processing that uses the sensor is executed, to thereby promote energy saving, because the light emitting unit emits light before mixed-color processing is executed despite the fact that the temperature of the sensor prior to mixed-correction is stable.

SUMMARY OF THE INVENTION

An image forming apparatus according to the present disclosure includes: an image forming unit configured to form an image on a sheet; a sensor comprising: a light emitting element; a diffraction grating configured to disperse light that is reflected by a measurement image on the sheet; a plurality of light receiving elements configured to receive beams of the reflected light dispersed by the diffraction grating; and a generation unit configured to generate information about an intensity of the light reflected by the measurement image, based on results of light reception by the plurality of light receiving elements; and a controller configured to control the image forming unit so that a first measurement image is formed on a first sheet, to control the sensor so that first information corresponding to the first measurement image is obtained, to control the image forming unit so that a second measurement-image is formed on a second sheet, to control the sensor so that second information corresponding to the second measurement image is obtained, to execute first correction processing based on the first information, and to execute second correction processing based on the second information, wherein the controller is configured to control the light emitting element to emit light before the first sheet arrives at the sensor, to control the sensor to turn off the light emitting element after measuring the first measurement image on the first sheet, and to control the light emitting element to emit light before the second sheet arrives at the sensor, and wherein alight emission time of the light emitting element prior to the arrival of the second sheet at the sensor is shorter than a light emission time of the light emitting element prior to the arrival of the first sheet at the sensor.

Further features of the present invention will become apparent from the following description of exemplary embodiments (with reference to the attached drawings).

DESCRIPTION OF THE EMBODIMENTS

An embodiment of the present invention is described below with reference to the drawings.

A first embodiment of the present invention is described.

Figure 1:
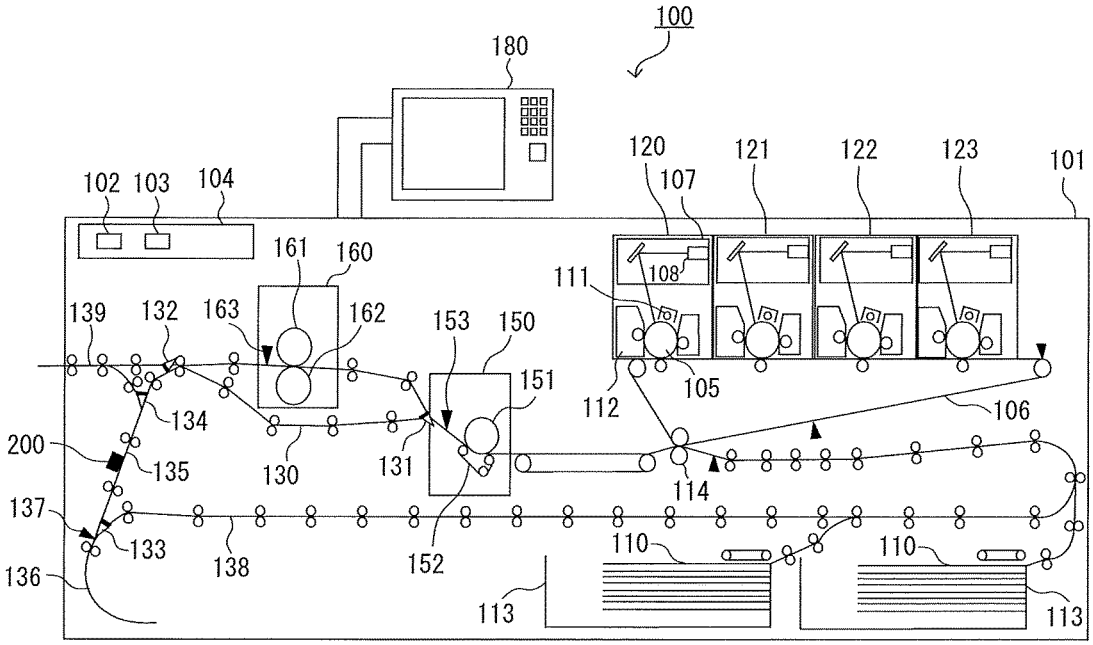
FIG. 1 is an explanatory diagram of an image forming apparatus.

FIG. 1 is a schematic explanatory diagram of an image forming apparatus 100 in the first embodiment. The image forming apparatus 100 has a casing 101, which includes a sensor, a motor, and other mechanisms that form the image forming apparatus 100, and a control board housing unit 104. The control board housing unit 104 houses, for example, an engine control unit 102 and a printer controller 103, which are configured to perform control related to sheet feeding processing and various other printing processes that are executed by the mechanisms. The engine control unit 102 and the printer controller 103 each include a central processing unit to execute various types of control. Alternatively, the image forming apparatus 100 may be configured so that a single CPU executes functions of the engine control unit 102 and the printer controller 103 both.

As illustrated in FIG. 1, the image forming apparatus 100 is provided with four stations 120, 121, 122, and 123, which correspond to the colors yellow (Y), magenta (M), cyan (C), and black (K). The stations 120, 121, 122, and 123 serve as an image forming unit configured to form an image by transferring toner onto a sheet 110.

The stations are each built almost entirely from parts common to one another. A photosensitive drum 105 is a type of image carrier, and is charged to a uniform surface potential by a primary charger 111. A latent image is formed on the photosensitive drum 105 by laser light output from a laser 108. A developer 112 is configured to form a toner image by developing the latent image using color material (a toner). The toner image (visible image) is transferred onto an intermediate transfer member 106. The toner image formed on the intermediate transfer member 106 is transferred by transfer rollers 114 onto the sheet 110 conveyed from sheet storage 113.

A fixing processing mechanism of this embodiment includes a first fixer 150 and second fixer 160 configured to fix, through heating and pressurization, the toner image transferred onto the sheet 110. The first fixer 150 includes a fixing roller 151 for heating the sheet 110, a pressurizing belt 152 for pressing the sheet 110 into contact with the fixing roller 151, and a first post-fixing sensor 150 configured to detect the completion of fixing. The rollers are hollow rollers, and each contains a heater (not shown) inside.

The second fixer 160 is placed downstream of the first fixer 150 in a direction in which the sheet 110 is conveyed. The second fixer 160 is configured to put gloss (luster) on the toner image fixed on the sheet 110 by the first fixer 150, and to secure the fixedness of the fixed toner image. The second fixer 160 includes, similarly to the first fixer 150, a fixing roller 161, a pressurizing roller 162, and a second post-fixing sensor 163. The sheets 110 of some types do not need to be run through the second fixer 160. In this case, the sheet 110 travels along a conveying path 130 while skipping the second fixer 160 for reducing energy consumption.

The sheet 110 that has passed through the first fixer 150 is conveyed to the second fixer 160 when, for example, settings for putting a lot of gloss on the sheet 100 are set, or the material of the sheet 110 is heavy paper or the like that requires a large amount of calories for fixing. In the case where the sheet 110 is plain paper or thin paper and settings for putting a lot of gloss are not set, on the other hand, the sheet 110 is conveyed along the conveying path 130 that detours around the second fixer 160. Whether the sheet 110 is conveyed to the second fixer 160 or detoured around the second fixer 160 is controlled by the switching of a flapper 131.

A conveying path switching flapper 132 is a guiding member configured to guide the sheet 110 to a conveying path 135 or to an ejection path 139, which leads to the outside. The front edge of the sheet 110 led to the conveying path 135 passes through an inversion sensor 137, and is conveyed to an inversion unit 136. When the inversion sensor 137 detects the rear edge of the sheet 110, the direction in which the sheet 110 is conveyed is switched. A conveying path switching flapper 133 is a guiding member configured to guide the sheet 110 to a conveying path 138, which is for forming an image on each side of the sheet 110, or to the conveying path 135.

Color sensors 200 each configured to detect a measurement image (hereinafter referred to as "patch image") on the sheet 110 are placed on the conveying path 135. Four color sensors 200 are arranged side by side in a direction orthogonal to the sheet conveying direction of the sheet 100 to detect four columns of patch images. When an operation unit 180 issues an instruction to detect colors, the engine control unit 102 executes density adjustment, tone characteristics adjustment, mixed-color adjustment, and the like.

A conveying path switching flapper 134 is a guiding member configured to guide the sheet 110 to the ejection path 139, which leads to the outside. The sheet 110 conveyed along the ejection path 139 is ejected to the outside of the image forming apparatus 100.

The color sensors are described below.

Figure 2:
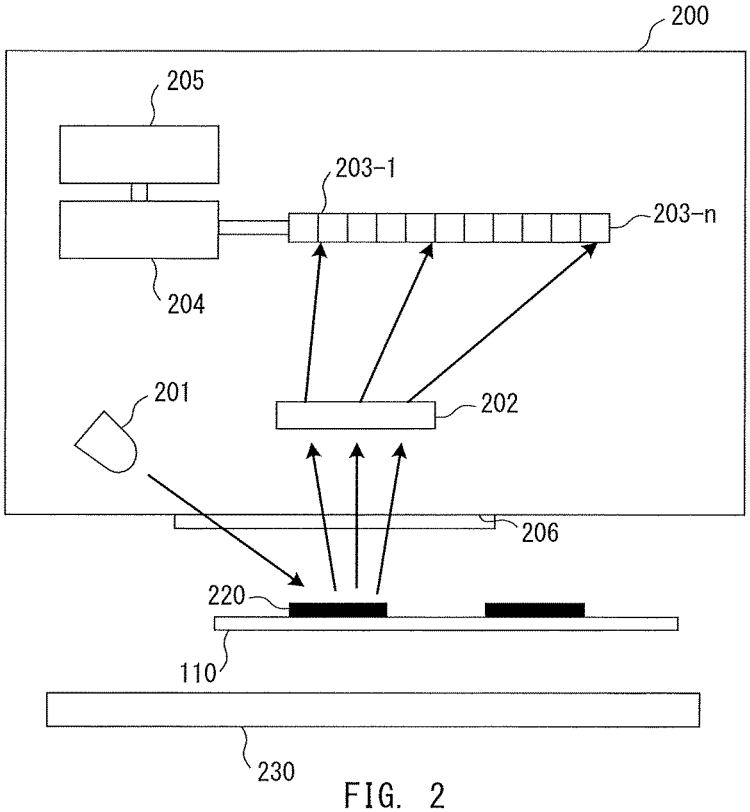
FIG. 2 is an explanatory diagram of a color sensor.

FIG. 2 is a schematic explanatory diagram of each color sensor 200. A white LED 201, a diffraction grating 202, line sensors 203-1 to 203-n , an arithmetic unit 204, and a memory 205 are provided inside the color sensor 200. The white LED 201 is alight emitting element configured to irradiate a patch image 220 on the sheet 110 with light. Light reflected by the patch image 220 passes through a sensor surface 206, which is made from a transparent member.

The diffraction grating 202 is configured to disperse light reflected by the patch image 220 into a spectrum of wavelengths. The line sensors 203 are light detecting elements that include n light receiving elements to detect the light broken into a spectrum of wavelengths by the diffraction grating 202. The arithmetic unit 204 is configured to perform various calculations from light intensity values of pixels that are detected by the line sensors 203.

The memory 205 is configured to store various types of data used by the arithmetic unit 204. The computing unit 204 includes, for example, a spectrum calculating unit configured to calculate the spectrum from light intensity values and a Lab calculating unit configured to calculate Lab values. The color sensor 200 may be provided with a lens configured to collect light that is irradiated from the white LED 201 onto the patch image 220 on the sheet 110. The color sensor 200 may be further provided with a lens configured to collect light that is reflected by the patch image 220 onto the diffraction grating 202.

The output of the white LED 201 fluctuates in response to changes in ambient temperature. In order to correct the fluctuations, a detachable white color reference board 230 is provided at a site that faces the sensor surface 206 of the color sensor 200. The white color reference board functions as a reference member used to correct the output value of the color sensor 200.

The white color reference board 230 illustrated in FIG. 2 is apart (detached) from the sensor surface 206 for the convenience of description. When measurement using the white color reference board 230 is actually performed, however, light reflected by the white color reference board 230 is measured with the white color reference board 230 kept close (attached) to the sensor surface 206. The detection value of the color sensor 200 is corrected based on this reflected light.

Figure 3:
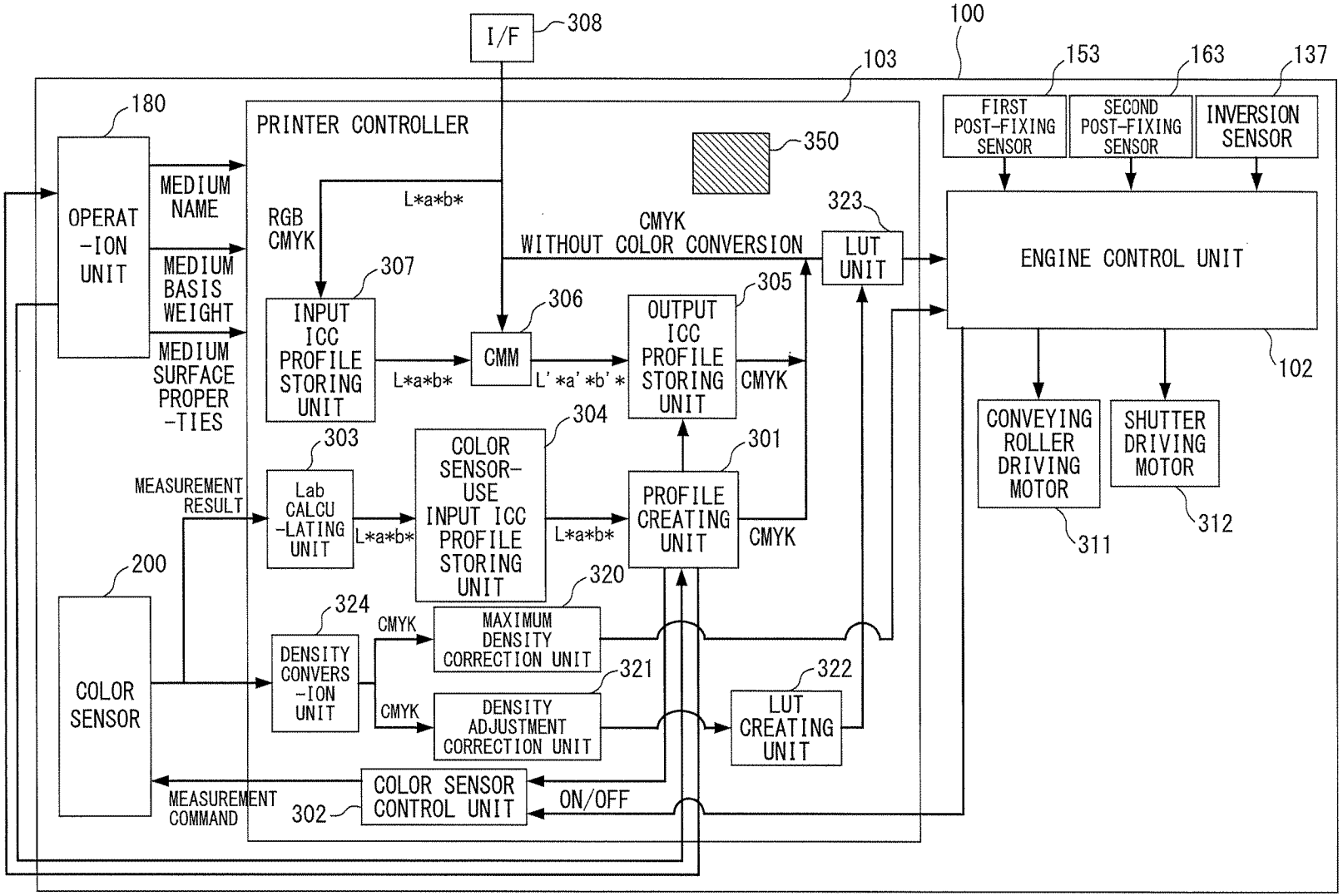
FIG. 3 is a block diagram for illustrating the system configuration of the image forming apparatus.

FIG. 3 is a block diagram for illustrating the system configuration of the image forming apparatus 100. Maximum density adjustment, tone characteristics adjustment, and mixed-color correction processing are described with reference to FIG. 3.

Maximum density adjustment is described below.

First, the printer controller 103 instructs the engine control unit 102 to output a test chart that is used for density adjustment. Density adjustment executed in this embodiment is maximum density adjustment described below. At this point, a patch image for maximum density adjustment is formed on the sheet 110 at a charge potential, an exposure intensity, and a development bias that are set in advance, or in the last maximum density adjustment. The engine control unit 102 then instructs a color sensor control unit 302 to measure the patch image.

The color sensor 200 measures the patch image and the result of the measurement is sent to a density conversion unit 324 as spectral reflectivity data. The density conversion unit 324 converts the spectral reflectivity data into CMYK density data. A density value is obtained from the conversion. The converted density data is sent to a maximum density correction unit 320.

The maximum density correction unit 320 calculates correction amounts of the charge potential, the exposure intensity, and the development bias so that the maximum density of an image to be output has desired values, and transmits the calculated correction amounts to the engine control unit 102. The engine control unit 102 uses the transmitted correction amounts of the charge potential, the exposure intensity, and the development bias in the next and subsequent image forming operation. The maximum density of an image to be output is adjusted through the operation described above.

Tone characteristics adjustment is described below.

After the maximum density adjustment processing is finished, the printer controller 103 instructs the engine control unit 102 to form a patch image in 16-level tone on the sheet 110. Image signals of a patch image in 16-level tone are expressed in, for example, hexadecimal notation as 00H, 10H, 20H, 30H, 40H, 50H, 60H, 70H, 80H, 90H, A0H, B0H, C0H, D0H, E0H, and FFH.

The correction amounts of the charge potential, the exposure intensity, and the development bias that have been calculated in maximum density adjustment are used to form the patch image in 16-level tone on the sheet 110. Once the patch image is formed in 16-level tone on the sheet 110, the engine control unit 102 instructs the color sensor control unit 302 to measure the patch image.

After the relevant color sensor 200 measures the patch image, the result of the measurement is sent to the density conversion unit 324 as spectral reflectivity data. The density conversion unit 324 converts the spectral reflectivity data into CMYK density data, and sends the converted density data to a density adjustment correction unit 321. The density adjustment correction unit 321 calculates a correction amount of the exposure amount so that desired tone properties are obtained. A lookup table (hereinafter abbreviated as LUT) creating unit 322 creates a monochromatic tone LUT, and sends the created LUT to an LUT unit 323 as signal values of the colors C, M, Y, and K.

Profiles are described below.

When executing mixed-color correction processing, the image forming apparatus 100 in this embodiment creates a profile from the result of detecting a patch image, and forms an output image by converting an input image using the profile.

Patch images of mixed colors are created by varying the halftone dot area ratio in three stages (0%, 50%, and 100%) for each of the four colors, C, M, Y, and K, and forming a patch image in every combination of the halftone dot area ratios of the four colors. Specifically, when the halftone dot area ratios of the four colors of a patch image are expressed by (C, M, Y, K), the first combination of the halftone dot area ratios is (0%, 0%, 0%, 0%), the second combination is (50%, 0%, 0%, 0%), the third combination is (50%, 50%, 0%, 0%) . . . and the eighty-first combination is (100%, 100%, 100%, 100%). Patch images of eighty-one (the biquadrate of 3) patterns in total are formed in this manner.

ICC profile, which has been accepted by the market in recent years, is used here as a profile that accomplishes excellent color reproducibility. However, the present invention is not limited to ICC profile. The present invention is applicable to any methods including Color Rendering Dictionary (CRD), which is employed by the level 2 and higher PostScript products proposed by Adobe (trademark), and a color separation table in Adobe Photoshop (trademark).

A user operates the operation unit 180 to give an instruction to execute color profile creating processing. The user gives this instruction when, for example, a customer engineer replaces parts, or prior to a job that requires precision in color matching, or when the accurate color of a final output needs to be known at the stage of designing or plotting.

The profile creating processing is executed in the printer controller 103 illustrated in the block diagram of FIG. 3. In FIG. 3, the printer controller 103 is expressed in blocks for easier understanding of processing executed by the printer controller 103. The printer controller 103 of FIG. 3 includes a central processing unit (CPU) (not shown). The CPU is configured to read a program for executing processing of a flow chart that is described later out of a storage unit 350, deploys the read program onto a random access memory (RAM), and executes the program. The Lab calculating unit 303 and other blocks of the printer controller 103 are therefore formed by the CPU by reading given programs out of the ROM and deploying the programs onto the RAM.

The operation unit 180 receives the profile creating instruction from the user and, in response to the instruction, a profile creating unit 301 outputs a CMYK color chart 210 to the engine control unit 102. The CMYK color chart 210 in this embodiment uses the ISO 12642 test form, and is output to the engine control unit 102 without an intervening profile.

The profile creating unit 301 sends a measurement instruction to the color sensor control unit 302. The engine control unit 102 controls the image forming apparatus 100 so that, for example, a process of charging, exposure, development, transfer, and fixing is executed. The ISO 12642 test form is formed on the sheet 110 as a result. The color sensor control unit 302 controls the color sensors 200 so that the ISO 12642 test form is measured. The color sensors 200 output spectral reflectivity data, which is the result of the measurement, to the Lab calculating unit 303 of the printer controller 103. The Lab calculating unit 303 converts the spectral reflectivity data into L*a*b* data, and outputs the L*a*b* data to the profile creating unit 301. The Lab calculating unit 303 may instead convert the spectral reflectivity data into CIE 1931 XYZ color system data, which is a color space signal independent of what type of device is used.

The profile creating unit 301 creates an output ICC profile from the relation between CMYK color signals output to the engine control unit 102 and the L*a*b* data input from the Lab calculating unit 303. The profile creating unit 301 stores the created output ICC profile in place of an output ICC profile that has been stored in an output ICC profile storing unit 305.

The ISO 12642 test form includes patches of CMYK color signals that cover the color reproduction range of an image that a general copying machine can output. The profile creating unit 301 therefore creates a color conversion table from the relation between the color signal values of the colors C, M, Y, and K and the measured L*a*b* values. In short, a conversion table for conversion from CMYK to Lab is created. An inverse conversion table is created from this conversion table.

The profile creating unit 301 receives a profile creating command from a host computer through an I/F 308, and outputs a created output ICC profile to the host computer through the I/F 308. The host computer can execute color conversion based on the received ICC profile using an application program.

The engine control unit 102 controls a shutter driving motor 312 used to attach/detach the white color reference board 230 to/from the sensor surface 206 of each color sensor 200.

Color conversion processing is described below.

Image signals that are input in color conversion for normal color output are assumed to have RGB signal values input from a scanner unit via the I/F 308, or standard printing CMYK signal values such as Japan Color. The input image signals are sent to an input ICC profile storing unit 307, which is for external input. The input ICC profile storing unit 307 executes RGB-to-L*a*b* conversion or CMYK-to-L*a*b* conversion, depending on the type of image signals input from the I/F 308. An input ICC profile stored in the input ICC profile storing unit 307 is formed of a plurality of LUTs.

The LUTs are, for example, a one-dimensional LUT for controlling the gamma of an input signal, a mixed-color LUT for what is called direct mapping, and a one-dimensional LUT for controlling the gamma of generated conversion data. The LUTs are used to convert input image signals from color space data that is dependent on the type of the device to L*a*b* data independent of the type of the device.

The image signals converted into L*a*b* chromaticity coordinates are input to a color management module (CMM) 306. The CMM 306 executes various types of color conversion. For example, the CMM 306 executes GUMAT conversion for mapping mismatches between a color space that is read by the scanner unit or other input devices and the output color reproduction range of the image forming apparatus 100 as an output device. The CMM 306 also executes color conversion for adjusting a mismatch between a light source type used in input and a light source type used in the observation of an output (in other words, a mismatch in color temperature settings).

The CMM 306 converts the L*a*b* data into L'*a'*b'* data in this manner, and outputs the L'*a'*b'* data to the output ICC profile storing unit 305. The profile created from measurements is already stored in the output ICC profile storing unit 305. The output ICC profile storing unit 305 therefore uses the newly created ICC profile in color conversion of the L'*a'*b'* data to convert the L'*a'*b'* data into CMYK signals dependent on the type of the output device, and outputs the CMYK signals to the engine control unit 102.

As illustrated in FIG. 3, image signals input from the scanner unit via the I/F 308 can be input directly to the CMM 306, and CMYK signals that do not undergo color conversion have an option of being input directly to the LUT unit 323.

Figure 4:
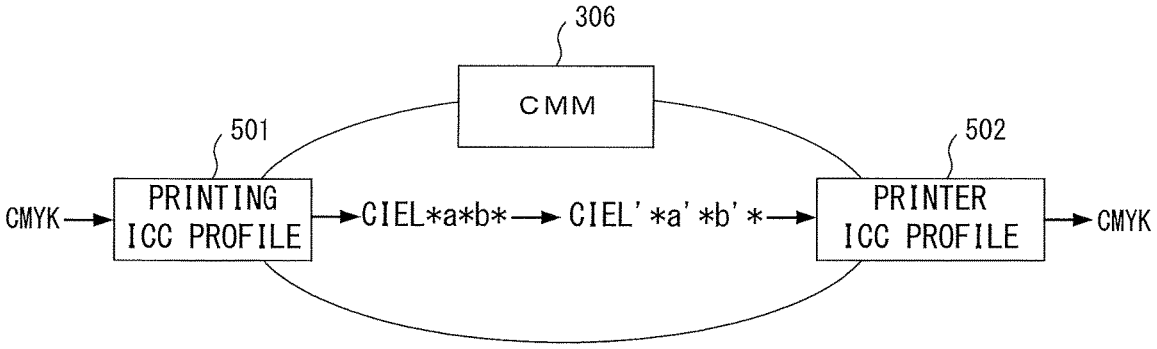
FIG. 4 is an explanatory diagram of the relation between a printing ICC profile and a printer ICC profile.

FIG. 4 is an explanatory diagram for illustrating the relation between a printing ICC profile and a printer ICC profile. As illustrated in FIG. 4, the CMM 306 is a module configured to handle color management, and to perform color conversion using an input profile and an output profile. In the example of FIG. 4, the input profile is a printing ICC profile 501, and the output profile is a printer IC profile 502.

The execution of various types of correction processing is described below.

Figure 5:
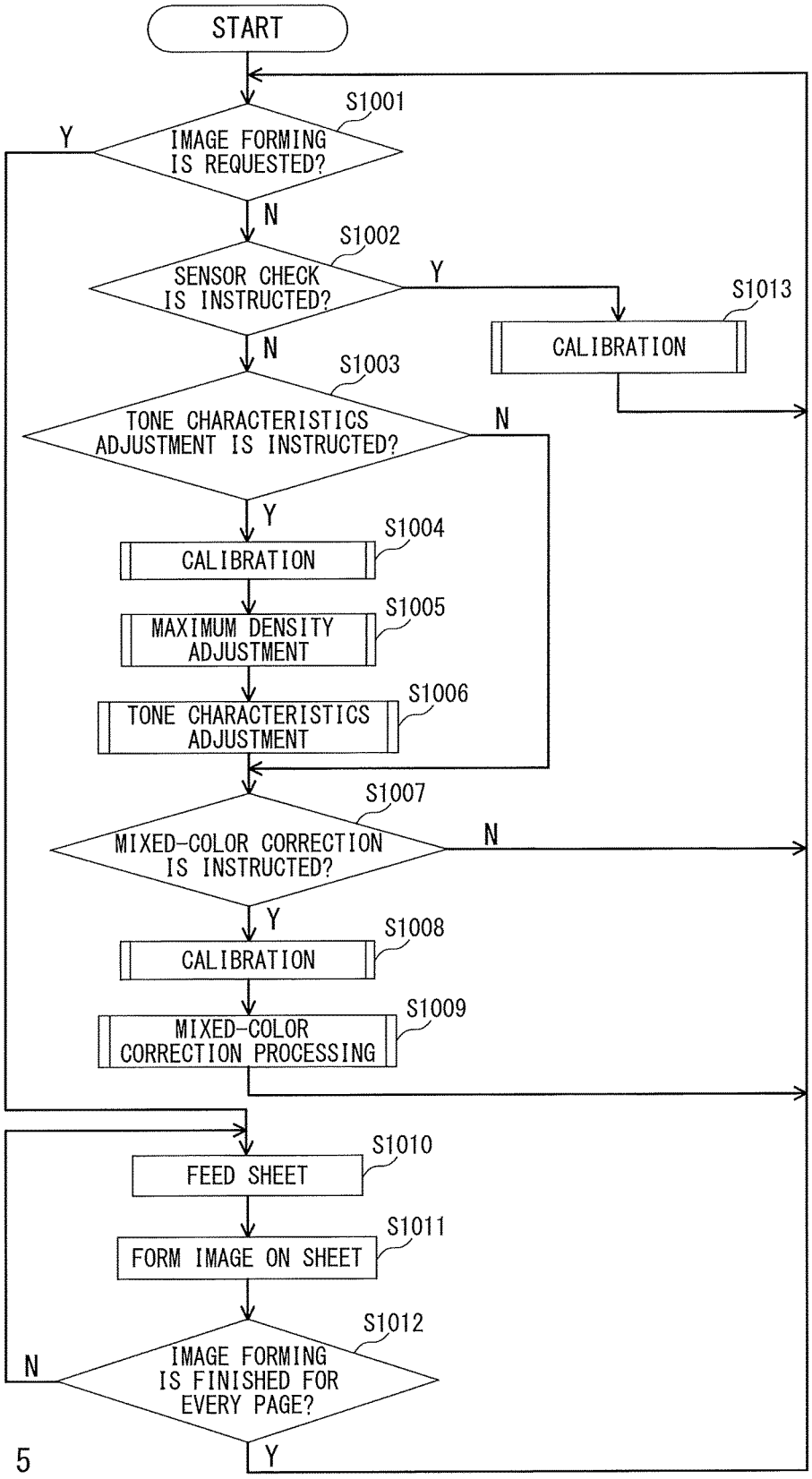
FIG. 5 is a flow chart for illustrating the operation of the image forming apparatus.

FIG. 5 is a flow chart for illustrating the operation of the image forming apparatus 100. The processing of the flow chart is executed by the printer controller 103. The printer controller 103 determines whether or not an image forming request has been made by the operation unit 180, or whether or not an image forming request has been made by the host computer via the I/F 308 (Step S1001).

In the case where no image forming request has been made (Step S1001: N), the printer controller 103 determines whether or not a sensor check instruction for checking a sensor has been input (Step S1002). A sensor check in this embodiment is executed when instructed by the user through the operation unit 180. Alternatively, a sensor check instruction may be issued automatically when, for example, the image forming apparatus 100 is activated for the first time for the day.

When it is determined that a sensor check instruction has been input (Step S1002: Y), the printer controller 103 performs calibration (Step S1003), and executes Step S1001 again. Details of the calibration are described later. When it is determined that a sensor check instruction has not been input (Step S1002: N), the printer controller 103 determines whether or not an instruction to execute tone characteristics adjustment has been received from the operation unit 180 (Step S1003). When it is determined that an instruction to execute tone characteristics adjustment has been received (Step S1003: Y), calibration (Step S1004), maximum density adjustment (Step S1005), and tone characteristics adjustment (Step S1006) are executed in order. After the color sensors 200 finish measuring patch images that are for tone characteristics adjustment in Step S1006, the printer controller 103 turns off the lights of the color sensors 200.

Details of the calibration and subsequent steps are described later.

Thereafter, the printer controller 103 determines whether or not an instruction to execute mixed-color correction has been received from the operation unit 180 (Step S1007).

When it is determined that an instruction to execute mixed-color correction has been received (Step S1007: Y), the printer controller 103 executes calibration (Step S1008) and mixed-color correction processing (Step S1009) in order, and executes Step S1001 once more. After the color sensors 200 finish measuring patch images that are for mixed-color correction processing in Step S1009, the printer controller 103 turns off the lights of the color sensors 200. Details of the mixed-color correction processing are described later. Calibration is executed before tone characteristics adjustment and before mixed-color correction processing in order to perform high-precision measurement with the sensors.

In the case where the printer controller 103 determines in Step S1001 that image forming has been requested (Step S1001: Y), on the other hand, the printer controller 103 feeds the sheet 110 from the sheet storage 113 (Step S1010). The printer controller 103 then forms a toner image on the sheet 110 (Step S1011), and determines whether or not image forming has been finished for every page (Step S1012). In the case where not every page is finished with image forming (Step S1012: N), the printer controller 103 returns to Step S1010 to form an image on the next page. In the case where image forming has been finished for every page (Step S1012: Y), the printer controller 103 returns to Step S1001.

Figure 6:
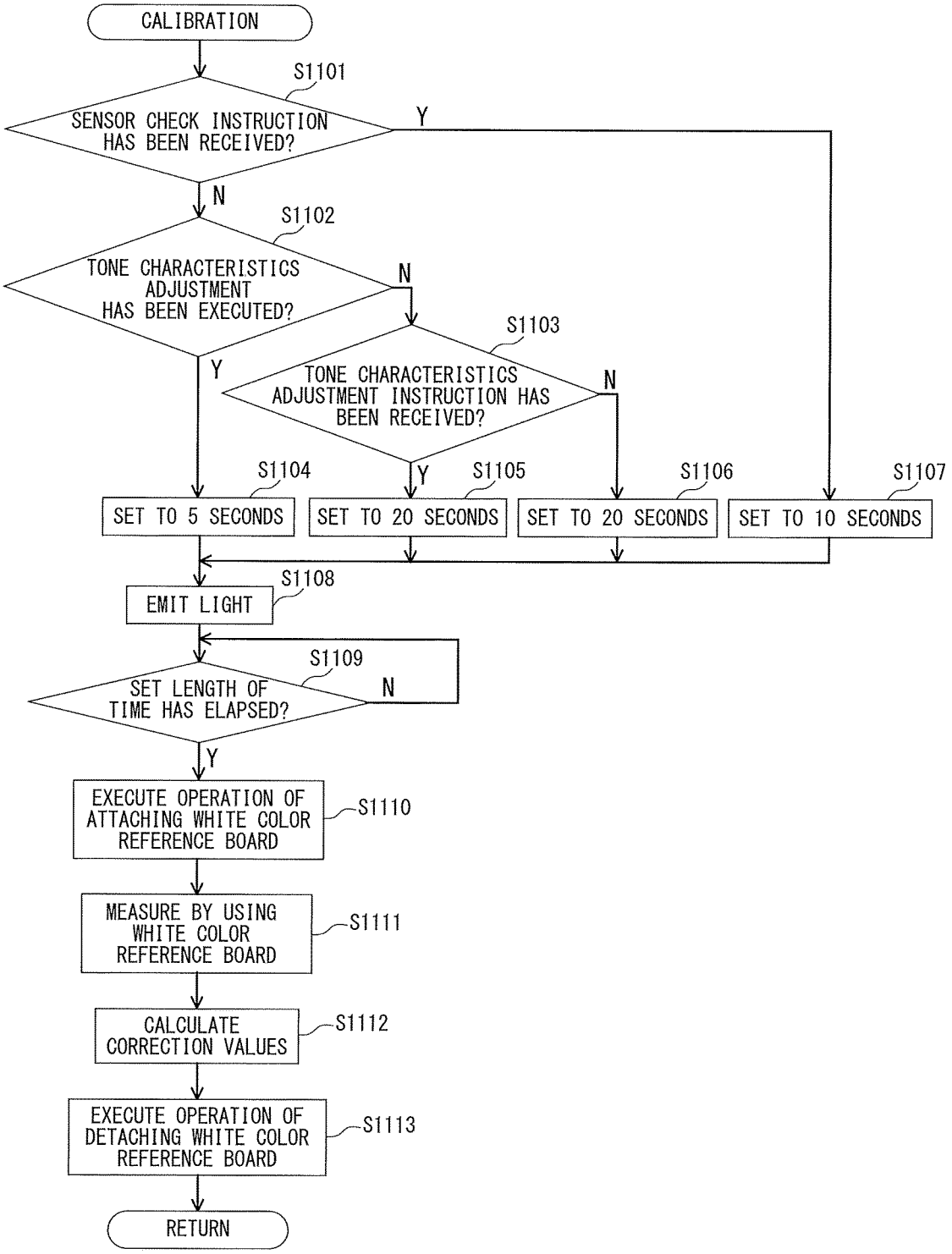
FIG. 6 is a flow chart for illustrating details of calibration.

FIG. 6 is a flow chart for illustrating details of calibration. Calibration of this flow chart is executed by the printer controller 103. The image forming apparatus 100 is controlled by the engine control unit 102 under instructions from the printer controller 103. Steps S1101 to S1106 are steps in which the printer controller 103 determines a preliminary light emission time of the white LED 201 in each color sensor 200. The color sensor 200 measures an image after the preliminary light emission time elapses. The prescribed value of the preliminary light emission time of the white LED 201 is set to 20 seconds in this embodiment. The printer controller 103 determines whether the preliminary light emission time of the white LED 201 is set to the prescribed value or a value different from the prescribed value by following the flow chart described below.

In Steps S1101 to S1107 of FIG. 6, the printer controller 103 determines which calibration out of one in Step S1013 of FIG. 5, one in Step S1004 of FIG. 5, and one in Step S1008 of FIG. 5 is to be executed. The printer controller 103 determines an appropriate preliminary light emission time of the white LED 201 based on the result of the determination.

The printer controller 103 determines in FIG. 6 whether or not a sensor check instruction has already been received (Step S1101). In the case where a sensor check instruction has been received (Step S1101: Y), it means that the result of the determination in Step S1002 of FIG. 5 is "Y". The printer controller 103 accordingly determines that the calibration of Step S1013 is to be executed, and sets the preliminary light emission time to 10 seconds, which is shorter than the prescribed value (Step S1107). The calibration executed in Step S1013 is calibration for detecting a failure in the color sensor 200, and does not require high precision for the measurement result. The preliminary light emission time in this case is therefore set shorter than the prescribed preliminary light emission time at 10 seconds.

In the case where a sensor check instruction has not been received (Step S1101: N), the printer controller 103 determines whether or not tone characteristics adjustment has already been executed (Step S1102). In order for the tone characteristics adjustment of Step S1006 in FIG. 5 to be executed, the result of the determination of Step S1003 needs to be "Y", and the calibration of Step S1004 and the tone characteristics adjustment of Step S1006 need to be executed beforehand.

Accordingly, when it is determined in FIG. 6 that tone characteristics adjustment has been executed (Step S1102: Y), it means that the calibration of Step S1008 is performed with the calibration of Step S1004 having already been executed. At the time the calibration of Step S1008 is executed, the temperature of the white LED 201 is higher than normal because preliminary light emission for the calibration of Step S1004 has been conducted. The preliminary light emission time for the calibration of Step S1008 is therefore set to 5 seconds, which is shorter than the prescribed preliminary light emission time and the preliminary light emission time in the sensor check described above.

The calibration of Step S1004 in FIG. 5 and the calibration of Step S1008 in FIG. 5 that is executed when the result of the determination of Step S1003 is "N", on the other hand, are executed without performing tone characteristics adjustment first. The calibration of Step S1004 is executed in the case where a tone characteristics adjustment instruction is received. The calibration of Step S1008 when the result of the determination of Step S1003 is "N" is executed in the case where a tone characteristics adjustment instruction is not received.

This is the basis for Step S1103 in which the printer controller 103 determines whether or not a tone characteristics adjustment instruction has been received in the case where tone characteristics adjustment has not been executed (Step S1102: N). In the case where a tone characteristics adjustment instruction has been received (Step S1103: Y), it means that the calibration of Step S1004 is to be executed. The printer controller 103 accordingly sets the preliminary light emission time to 20 seconds, which is the prescribed value, in order to raise the temperature of the color sensor 200 and keep the temperature steady at the raised level.

In the case where a tone characteristics adjustment instruction has not been received (Step S1103: N), the calibration of Step S1008 is to be executed. In this case also, the printer controller 103 sets the preliminary light emission time to 20 seconds in order to raise the temperature of the color sensor 200 and keep the temperature steady at the raised level. The preliminary light emission time in calibration executed before tone characteristics adjustment and the preliminary light emission time in calibration executed prior to mixed-color correction, which have the same value in this embodiment, may have different values. While the preliminary light emission time in this embodiment is set based on whether or not the execution of tone characteristics adjustment precedes calibration, the length of preliminary light emission may instead be determined based on the interval of turning off the white LED.

After the setting of the preliminary light emission time in Steps S1101 to S1107 is completed, the printer controller 103 causes the white LED 201 to emit light for preliminary light emission (Step S1108). The printer controller 103 then determines whether or not the preliminary light emission time set in Steps S1101 to S1106 has elapsed (Step S1109). In the case where the preliminary light emission time has not elapsed (Step S1109: N), Step S1109 is executed again. In the case where the preliminary light emission time has elapsed (Step S1109: Y), the printer controller 103 drives the shutter driving motor 312 to execute the operation of attaching the white color reference board (Step S1110). The printer controller 103 controls the color sensor 200 so that measurement is performed using the white color reference board (Step S1111), and calibrates the sensor by using the result of the measurement (Step S1112). Thereafter, the printer controller 103 drives the shutter driving motor 312 to execute the operation of detaching the white color reference board (Step S1113).

Figure 7:
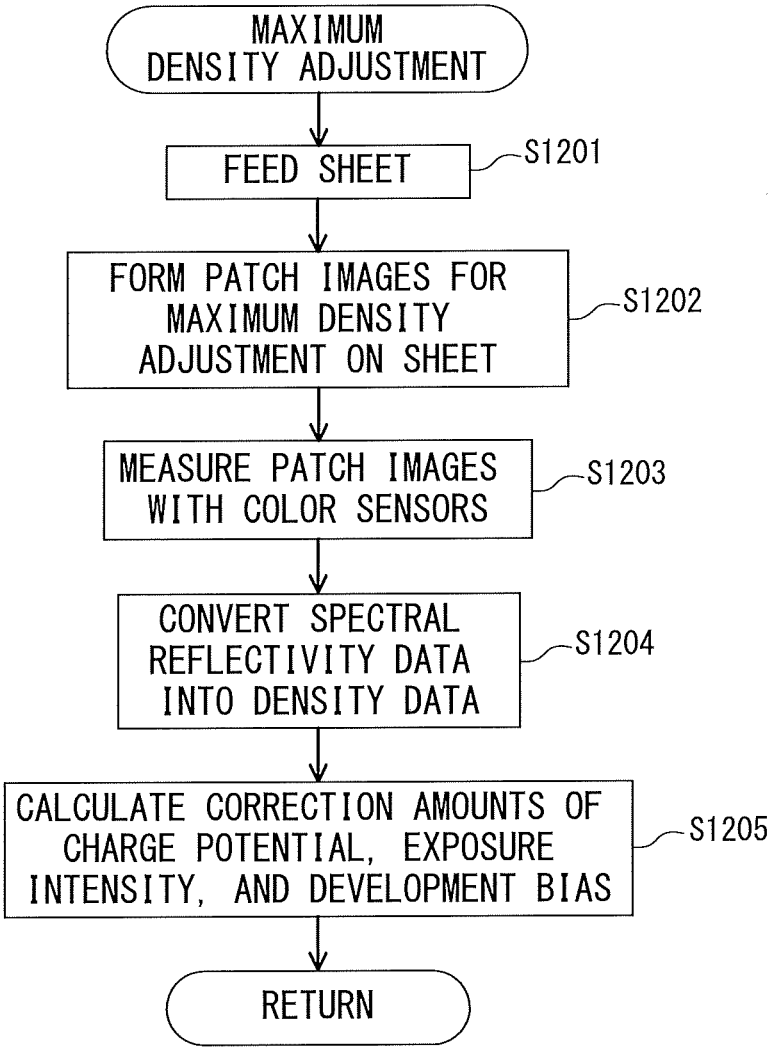
FIG. 7 is a flow chart for illustrating maximum density adjustment operation.

FIG. 7 is a flow chart for illustrating maximum density adjustment operation. Maximum density adjustment operation of this flowchart is executed by the printer controller 103. The image forming apparatus 100 is controlled by the engine control unit 102 under instructions from the printer controller 103.

The printer controller 103 first feeds the sheet 110 from the sheet storage 113 (Step S1201), and forms patch images that are for maximum density adjustment on the sheet 110 (Step S1202). The printer controller 103 next detects that the sheet 110 has arrived at the color sensors 200 and causes the color sensors 200 to measure the patch images (Step S1203).

Further, the printer controller 103 uses the density conversion unit 324 to convert spectral reflectivity data output from the color sensors 200 into CMYK density data (Step S1204). Based on the converted density data, the printer controller 103 then calculates correction amounts of the charge potential, the exposure intensity, and the development bias (Step S1205). The correction amounts calculated in this step are stored in the storage unit 350 to be used later.

Figure 8:
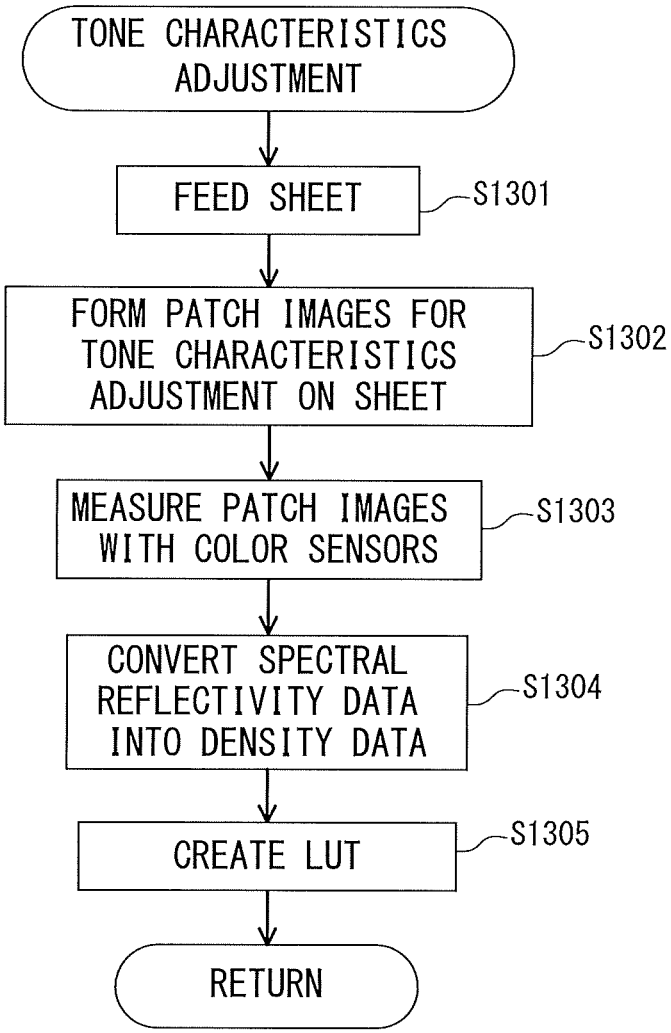
FIG. 8 is a flow chart for illustrating tone characteristics adjustment operation.

FIG. 8 is a flow chart for illustrating tone characteristics adjustment operation. Tone characteristics adjustment operation of this flow chart is executed by the printer controller 103. The image forming apparatus 100 is controlled by the engine control unit 102 under instructions from the printer controller 103.

The printer controller 103 first feeds the sheet 110 from the sheet storage 113 (Step S1301), and forms patch images (16 tone levels) that are for tone characteristics adjustment on the sheet 110 (Step S1302). The printer controller 103 next detects that the sheet 110 has arrived at the color sensors 200 and causes the color sensors 200 to measure the patch images (Step S1303). Further, the printer controller 103 uses the density conversion unit 324 to convert spectral reflectivity data output from the color sensors 200 into CMYK density data (Step S1304). Based on the converted density data, the printer controller 103 then calculates correction amounts of the exposure intensity to create an LUT for tone characteristics adjustment (Step S1305). The LUT calculated in this step is set in the LUT unit 323 to be used later.

Figure 9:
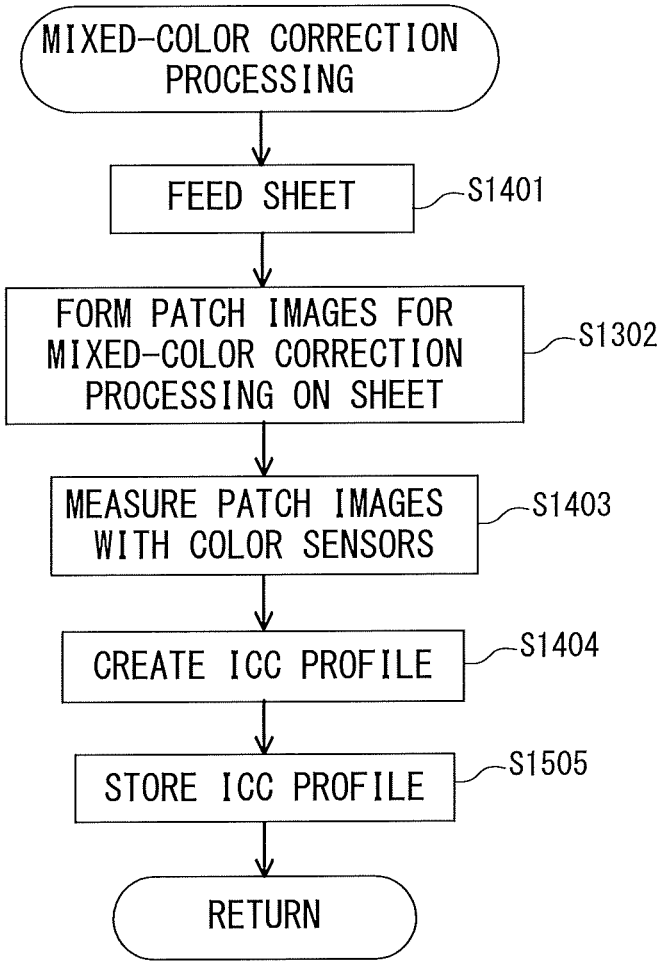
FIG. 9 is a flow chart for illustrating the operation of mixed-color correction processing.

FIG. 9 is a flow chart for illustrating the operation of mixed-color correction processing. Mixed-color correction processing of this flow chart is executed by the printer controller 103. The image forming apparatus 100 is controlled by the engine control unit 102 under instructions from the printer controller 103.

The printer controller 103 first feeds the sheet 110 from the sheet storage 113 (Step S1401), and forms patch images that are for mixed-color correction processing on the sheet 110 (Step S1402). The printer controller 103 next detects that the sheet 110 has arrived at the color sensors 200 and uses the color sensors 200 to measure the patch images (Step S1403). The printer controller 103 then uses the Lab calculating unit 303 to calculate chromaticity data (L*a*b*) from spectral reflectivity data output by the color sensors 200. Based on the chromaticity data (L*a*b*), the printer controller 103 creates an ICC profile through the processing described above (Step S1404), and stores the created profile in the output ICC profile storing unit 305 (Step S1405).

This concludes a description on the embodiment of the present invention. However, the present invention is not limited to the embodiment described above, and can be carried out in various modes. For example, while the CPU of the printer controller 103 reads a program out of the storage unit 350 and deploys the program onto the RAM to execute the program in the described embodiment, a program received from an external apparatus, an external recording medium, or the like as the need arises may be deployed onto the RAM.

Further, according to the present invention, power consumption can be reduced by optimizing a preliminary operation of the sensor.

The above-mentioned embodiment is given just for the purpose of describing the present invention more specifically, and the scope of the present invention is not limited by the embodiment. The present invention encompasses various modes that conform to the spirit of the present invention. For instance, parts of the embodiments described above may be combined to suit individual cases.

The processing procedures described in the embodiment of the present invention may be controlled by a processing control program (a computer program) installed in a computer. A recording medium on which the processing control program is recorded in a manner that allows a computer to execute the processing control program is also included in the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-247355, filed Dec. 18, 2015 which is hereby incorporated by reference herein in its entirety.

What is claimed is:

1. An image forming apparatus, comprising:

an image forming unit configured to form an image on a sheet;

a sensor comprising:

a light emitting element;

a diffraction grating configured to disperse light that is reflected by a measurement image on the sheet;

a plurality of light receiving elements configured to receive the reflected light dispersed by the diffraction grating; and a generation unit configured to generate information related to an intensity of the light reflected by the measurement image, based on results of light reception by the plurality of light receiving elements; and a controller configured to control the image forming unit to form a first measurement image on a first sheet, to control the sensor to obtain first information corresponding to the first measurement image, to control the image forming unit to form a second measurement image on a second sheet, to control the sensor to obtain second information corresponding to the second measurement image, to execute first correction processing based on the first information, and to execute second correction processing based on the second information, wherein the controller controls the light emitting element to emit light before the first sheet arrives at the sensor, controls the sensor to turn off the light emitting element after measuring the first measurement image on the first sheet, and controls the light emitting element to emit light before the second sheet arrives at the sensor, and wherein a light emission time of the light emitting element prior to the arrival of the second sheet at the sensor is shorter than a light emission time of the light emitting element prior to the arrival of the first sheet at the sensor.

2. The image forming apparatus according to claim 1, wherein the controller executes maximum density adjustment after the first information is obtained.

3. The image forming apparatus according to claim 1, wherein the controller executes processing of correcting tone characteristics after the first information is obtained.

4. The image forming apparatus according to claim 1, wherein the controller executes, after the second information is obtained, processing of generating a conversion condition for converting image data based on a result of measuring a measurement image that has a plurality of colors each in a different layer.

5. The image forming apparatus according to claim 1, wherein the controller controls, in a case where an instruction to check the sensor is input, the image forming unit to form a third measurement image on a third sheet, and to control the sensor to obtain third information corresponding to the third measurement image.

6. The image forming apparatus according to claim 5, wherein the controller controls the light emitting element to emit light, before the third sheet arrives at the sensor, for a length of time that is shorter than the light emission time of the light emitting element prior to the arrival of the first sheet at the sensor and longer than the light emission time of the light emitting element prior to the arrival of the second sheet at the sensor.

7. The image forming apparatus according to claim 1, further comprising a reference member, wherein the controller controls the sensor to measure light reflected by the reference member after a given length of time elapses since light emission of the light emitting element.

8. The image forming apparatus according to claim 7, wherein the reference member comprises a white color reference board.

9. A method executed by an image forming apparatus, the image forming apparatus comprising:

an image forming unit configured to form an image on a sheet;

a sensor comprising:

a light emitting element;

a plurality of light receiving elements configured to receive light that is reflected by a measurement image on the sheet; and a generation unit configured to generate information related to an intensity of the light reflected by the measurement image, based on results of light reception by the plurality of light receiving elements; and a controller, the method comprising:

forming a first measurement image on a first sheet;

obtaining first information corresponding to the first measurement image by the sensor;

forming a second measurement image on a second sheet;

obtaining second information corresponding to the second measurement image by the sensor;

executing first correction processing based on the first information;

executing second correction processing based on the second information;

controlling the light emitting element to emit light before the first sheet arrives at the sensor;

controlling the sensor to turn off the light emitting element after measuring the first measurement image on the first sheet; and controlling the light emitting element to emit light before the second sheet arrives at the sensor, wherein a light emission time of the light emitting element prior to the arrival of the second sheet at the sensor is shorter than a light emission time of the light emitting element prior to the arrival of the first sheet at the sensor.

* * * * *